US009207636B1

(12) United States Patent
Hamada

(10) Patent No.: US 9,207,636 B1
(45) Date of Patent: Dec. 8, 2015

(54) IMAGE FORMING APPARATUS

(71) Applicant: KYOCERA Document Solutions Inc., Osaka (JP)

(72) Inventor: Toshiyuki Hamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/706,597

(22) Filed: May 7, 2015

(30) Foreign Application Priority Data

May 20, 2014 (JP) ..... 2014-103989

(51) Int. Cl.
*G03G 21/20* (2006.01)
*G03G 15/20* (2006.01)

(52) U.S. Cl.
CPC ..... *G03G 21/206* (2013.01); *G03G 15/2039* (2013.01); *G03G 21/203* (2013.01); *G03G 2221/1645* (2013.01)

(58) Field of Classification Search
CPC ... G03G 21/20; G03G 21/203; G03G 21/206; G03G 2221/1645
See application file for complete search history.

(56) References Cited

U.S. PATENT DOCUMENTS

2011/0211859 A1* 9/2011 Shimoyama ..... G03G 15/2064 399/93
2011/0211860 A1* 9/2011 Shimoyama ..... G03G 15/2064 399/93
2013/0051835 A1* 2/2013 Kubo ..... G03G 21/206 399/92
2013/0243453 A1 9/2013 Horie et al. ..... 399/44
2014/0210928 A1* 7/2014 Yokoi ..... G03G 21/203 347/118
2014/0321868 A1* 10/2014 Tsutsumi ..... G03G 21/206 399/44
2015/0160609 A1* 6/2015 Seong ..... G03G 21/206 399/44

FOREIGN PATENT DOCUMENTS

JP 2013-195662 A 9/2013

* cited by examiner

*Primary Examiner* — David Gray
*Assistant Examiner* — Carla Therrien
(74) *Attorney, Agent, or Firm* — Stein IP, LLC

(57) ABSTRACT

An image forming apparatus has a fusing device in which a recording medium carrying an unfused toner image is nipped at a fusing nip formed between a heated member and a pressing member to fuse and fix the unfused toner image to the recording medium, and an exhaust duct unit through which air around the fusing device is expelled outside. The exhaust duct unit allows a choice between a first exhaust path through which outside air sucked into the image forming apparatus is passed through a space around the fusing device and is then expelled out of the image forming apparatus, and a second exhaust path in which a filter for collecting particles contained in an air stream is arranged and through which the air around the fusing device is passed through the filter and is then expelled out of the image forming apparatus.

6 Claims, 7 Drawing Sheets

IMAGE FORMING APPARATUS

INCORPORATION BY REFERENCE

This application is based upon and claims the benefit of priority from the corresponding Japanese Patent Application No. 2014-103989 filed on May 20, 2014, the entire contents of which are incorporated herein by reference.

BACKGROUND

The present disclosure relates to image forming apparatuses such as copier, printers, facsimile machines, and multifunction peripherals functioning as more than one of those devices. More particularly, the present disclosure relates to a method of expelling air inside an image forming apparatus out of it with a fan.

In an image forming apparatus relying on electrophotography, toner is attached to an electrostatic latent image formed on a photosensitive member to form a toner image, then the toner image is transferred to paper, and then the toner image on the paper is fused by a fusing device.

In a fusing device of a heating type which fuses a toner image to paper by heating the paper, the heating can cause release of ultrafine particles (UFPs) from inside to outside the image forming apparatus. Today, with increasing consciousness of environmental issues, release of ultrafine particles (UFPs) into the environment is sought to be suppressed. Ultrafine particles (UFPs) refers to, out of suspended particulate matter, particles with diameters of 100 nm or less. It has come to be known that ultrafine particles (UFPs) arise chiefly from silicone rubber used as an elastic layer in a heating roller or the like. Specifically, when silicone rubber is heated to over a predetermined temperature, low-molecular siloxanes are produced, which spread as ultrafine particles (UFPs).

Solutions are offered by some known technologies for suppressing release of ultrafine particles (UFPs) out of image forming apparatuses. For example, an image forming apparatus is known which is provided with a louver for changing the size of the opening of an exhaust port, wherein the opening and closing of the louver is controlled based on the temperature sensed by a temperature sensor that senses the temperature around a fusing roller. In this image forming apparatus, a filter for collecting ultrafine particles (UFPs) and the like is provided in the exhaust port to minimize release of ultrafine particles (UFPs) and the like out of the image forming apparatus, and when the temperature sensed by the temperature sensor exceeds 170° C., the louver is automatically closed to prevent release of ultrafine particles (UFPs), ozone, toner and other particles, etc. out of the image forming apparatus.

SUMMARY

According to one aspect of the present disclosure, an image forming apparatus includes a fusing device and an exhaust duct unit. The fusing device has a heated member which is heated by a heat source and a pressing member which is put in pressed contact with the heated member, and a recording medium carrying an unfused toner image is nipped at the fusing nip formed between the heated member and the pressing member so as to fuse and fix the unfused toner image to the recording medium. The exhaust duct unit is arranged over the fusing device, beside it, and expels air around the fusing device out of the image forming apparatus. The exhaust path through the exhaust duct unit is selectable between a first exhaust path through which outside air sucked into the image forming apparatus is passed through a space around the fusing device and is then expelled out of the image forming apparatus, and a second exhaust path in which a filter for collecting particles contained in an air stream is arranged and through which the air around the fusing device is passed through the filter and is then expelled out of the image forming apparatus.

Further features and advantages of the present disclosure will become apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
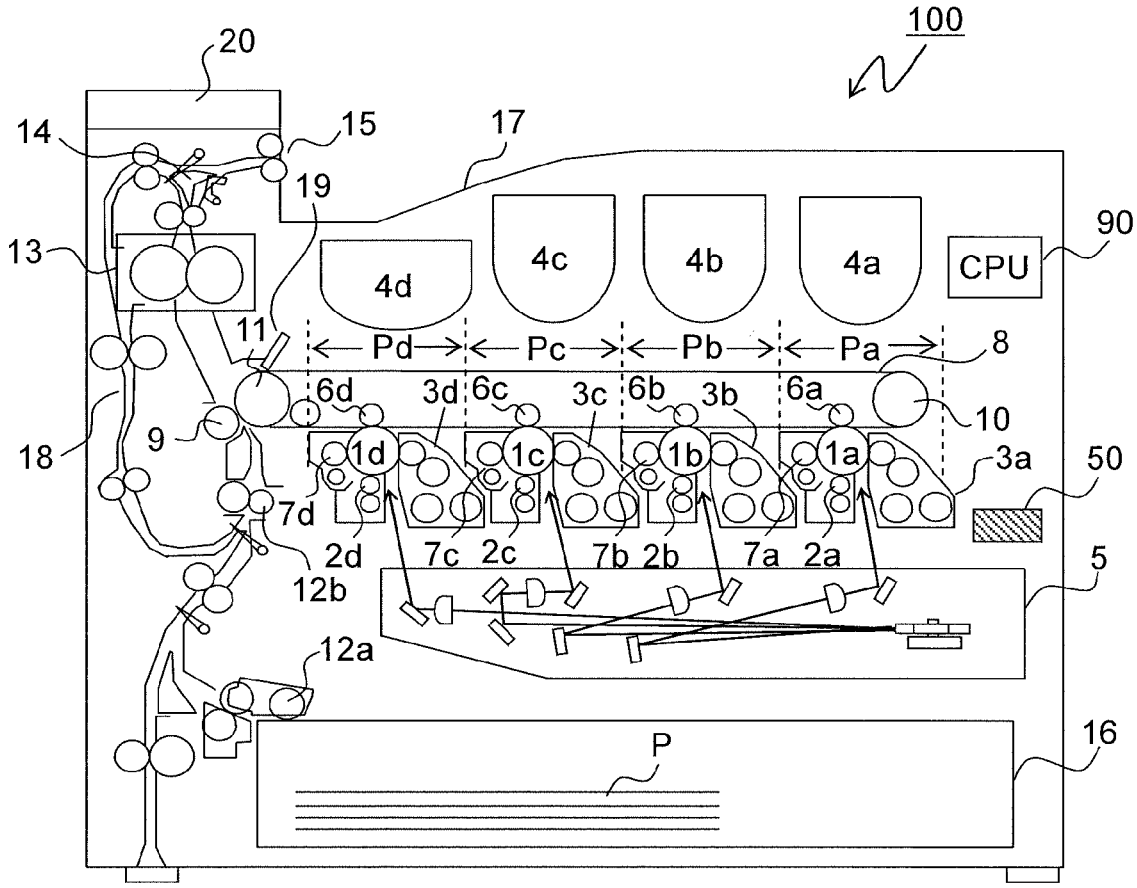
FIG. 1 is a schematic sectional view showing an internal construction of a color printer 100 according to one embodiment of the present disclosure.

Hereinafter, an embodiment of the present disclosure will be described with reference to the accompanying drawings. FIG. 1 is a schematic sectional view showing a construction of an image forming apparatus according to one embodiment of the present disclosure. Shown there as an example of an image forming apparatus is a tandem-type color printer. Inside the body of the color printer 100, four image forming sections Pa, Pb, Pc, and Pd are arranged in this order from the upstream side (in FIG. 1, the right side) with respect to the transport direction of a recording medium. These image forming sections Pa to Pd are provided to correspond to images of four different colors (magenta, cyan, yellow, and black), and respectively form a magenta, a cyan, a yellow, and a black image sequentially, each through the processes of electrostatic charging, exposure to light, image development, and transfer.

The image forming sections Pa to Pd are furnished with photosensitive drums 1*a*, 1*b*, 1*c*, and 1*d* which carry visible images (toner images) of the different colors. An intermediary transfer belt 8 which is rotated in the clockwise direction in FIG. 1 by a driving means (unillustrated) is provided to abut on the image forming sections Pa to Pd. The toner images formed on those photosensitive drums 1*a* to 1*d* are primarily transferred, one after the next, to the intermediary transfer belt 8 which moves while abutting on the photosensitive drums 1*a* to 1*d*, so as to be superimposed on one another. The resulting image is then, by the action of a secondary transfer roller 9, secondarily transferred to a sheet of paper P as one example of a recording medium. The image is then fused to the sheet P in a fusing device 13, and the sheet is then discharged out of the body of the color printer 100. While the photosensitive drums 1*a* to 1*d* are rotated in the counter-clockwise direction in FIG. 1, an image forming process is performed with respect to each of the photosensitive drums 1*a* to 1*d*.

Sheets of paper P to which to transfer toner images are contained in a sheet cassette 16 arranged in a lower part of the body of the color printer 100. From there, a sheet P is transported via a sheet feed roller 12*a* and a registration roller pair 12*b* to the nip between the secondary transfer roller 9 and a driving roller 11, which will be described later, of the intermediary transfer belt 8. Used as the intermediary transfer belt 8 is a sheet of a dielectric resin, typically a belt with no seam (i.e., a seamless belt). On the downstream side of the secondary transfer roller 9 with respect to the rotation direction of the intermediary transfer belt 8, a belt cleaner 19 is arranged which is the shape of a blade and which serves to remove toner left behind on the surface of the intermediary transfer belt 8.

Next, the image forming sections Pa to Pd will be described. Around and under the rotatably arranged photosensitive drums 1*a* to 1*d*, there are arranged chargers 2*a*, 2*b*, 2*c*, and 2*d* for electrostatically charting the photosensitive drums 1*a* to 1*d*; an exposing device 5 for exposing the photosensitive drums 1*a* to 1*d* to image information; developing devices 3*a*, 3*b*, 3*c*, and 3*d* for forming toner images on the photosensitive drums 1*a* to 1*d*; and cleaning units 7*a*, 7*b*, 7*c*, and 7*d* for removing developer (toner) left behind on the photosensitive drums 1*a* to 1*d*.

When image data is fed in from a host device such as a personal computer, first, the chargers 2*a* to 2*d* electrostatically charge the surfaces of the photosensitive drums 1*a* to 1*d* uniformly. Then, the exposing device 5 irradiates the surfaces of the photosensitive drums 1*a* to 1*d* with light according to the image data to form electrostatic latent images according to the image data on the photosensitive drums 1*a* to 1*d*. The developing devices 3*a* to 3*d* are charged with predetermined amounts of two-component developer containing toner of the different colors, namely magenta, cyan, yellow, and black respectively. As the formation of toner images proceeds as will be described later, when the proportion of toner in the two-component developer stored in the developing devices 3*a* to 3*d* falls below a prescribed level, developer is supplied from toner containers 4*a* to 4*d* to the developing devices 3*a* to 3*d* respectively. The toner in the developer is fed onto the photosensitive drums 1*a* to 1*d* by the developing devices 3*a* to 3*d* to electrostatically attach to them, and thereby toner images according to the electrostatic latent images formed by exposure to light from the exposing device 5 are formed.

Then, primary transfer rollers 6*a* to 6*d* apply an electric field with a predetermined transfer voltage between themselves and the photosensitive drums 1*a* to 1*d*, so that the magenta, cyan, yellow, and black toner images on the photosensitive drums 1*a* to 1*d* are primarily transferred to the intermediary transfer belt 8. These images of four colors are formed with a predetermined positional relationship relative to one another which is previously determined to form a predetermined full-color image. Then, in preparation to the subsequent formation of new electrostatic latent images, the toner and the like left behind on the surfaces of the photosensitive drums 1*a* to 1*d* after primary transfer is removed by the cleaning units 7*a* to 7*d*.

The intermediary transfer belt 8 is wound around a driven roller 10 on the upstream side and the driving roller 11 on the upstream side. As the driving roller 11 starts to rotate by being driven by a drive motor (unillustrated), the intermediary transfer belt 8 starts to rotate in the clockwise direction. Meanwhile, a sheet P is transported, with predetermined timing, from the registration roller pair 12*b* to the nip (secondary transfer nip) between the driving roller 11 and the secondary transfer roller 9, the latter being arranged to abut on the former. Thus, the full-color image on the intermediary transfer belt 8 is transferred to the sheet P. The sheet P having the toner image transferred to it is transported on to the fusing device 13.

In the fusing device 13, the sheet P is exposed to heat and pressure by a fusing roller 131 and a pressing roller 132 (see FIG. 3), so that the toner image is fused to the surface of the sheet P, thereby forming a predetermined full-color image. The sheet P having the full-color image formed on it is then switched between alternative transport directions by a branching section 14 which branches in a plurality of directions. When image formation is performed on only one side of the sheet P, the sheet P is immediately discharged onto a discharge tray 17 by a discharge roller pair 15.

On the other hand, when image formation is performed on both sides of the sheet P, the sheet P having passed through the fusing device 13 is first transported toward the discharge roller pair 15, and when the trailing edge of the sheet P has passed through the branching section 14, the discharge roller pair 15 is rotated in the reverse direction and the branching section 14 is switched to a different transport direction. Thus, the sheet P is forwarded, starting with its trailing edge, to a reversing transport passage 18, through which the sheet P is transported, now with the image surface reversed, once again to the secondary transfer nip. Then, the next image formed on the intermediary transfer belt 8 is transferred by the secondary transfer roller 9 to the side of the sheet P on which no image has been formed. The sheet is then transported to the fusing device 13, where the toner image is fused, and is then discharged onto the discharge tray 17.

Over the fusing device 13, there is provided an exhaust duct unit 20 for expelling the air inside the color printer 100 to the outside. Inside the color printer 100, there are further provided an exterior humidity sensor 50 for sensing relative humidity outside the color printer 100, and a controller (CPU) 90 for controlling the operation of the image forming sections Pa to Pd, the exposing device 5, the fusing device 13, the exhaust duct unit 20, etc. The exterior humidity sensor 50 is arranged, for example, over the sheet cassette 16 in FIG. 1 so as not to be influenced by a heat generating component, but may instead be arranged at any other place where it can accurately sense humidity outside the color printer 100. The result of sensing by the exterior humidity sensor 50 is transmitted to the controller 90.

Figure 2:
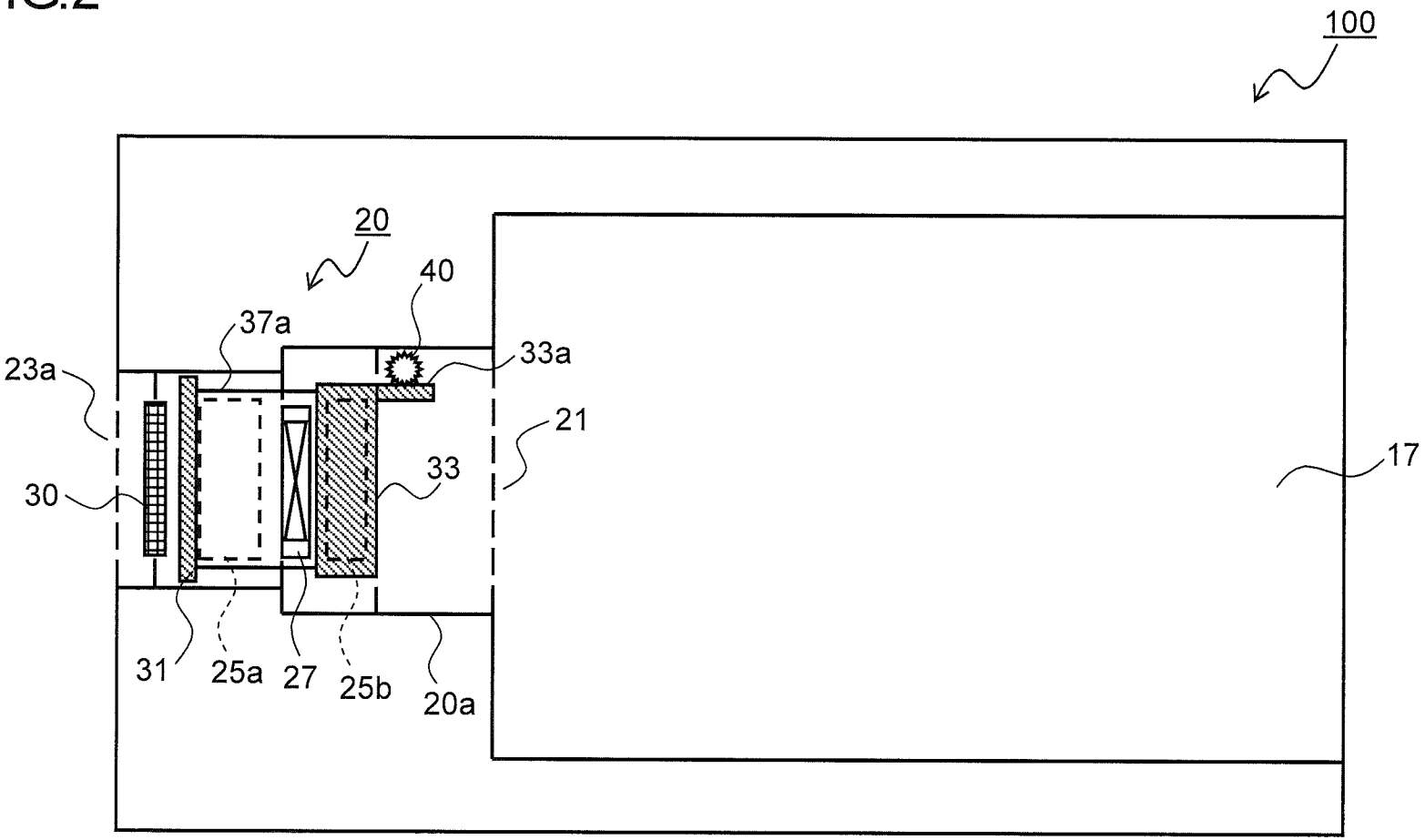
FIG. 2 is a sectional plan view of and around an exhaust duct unit 20 in the color printer 100 shown in FIG. 1.
Figure 3:
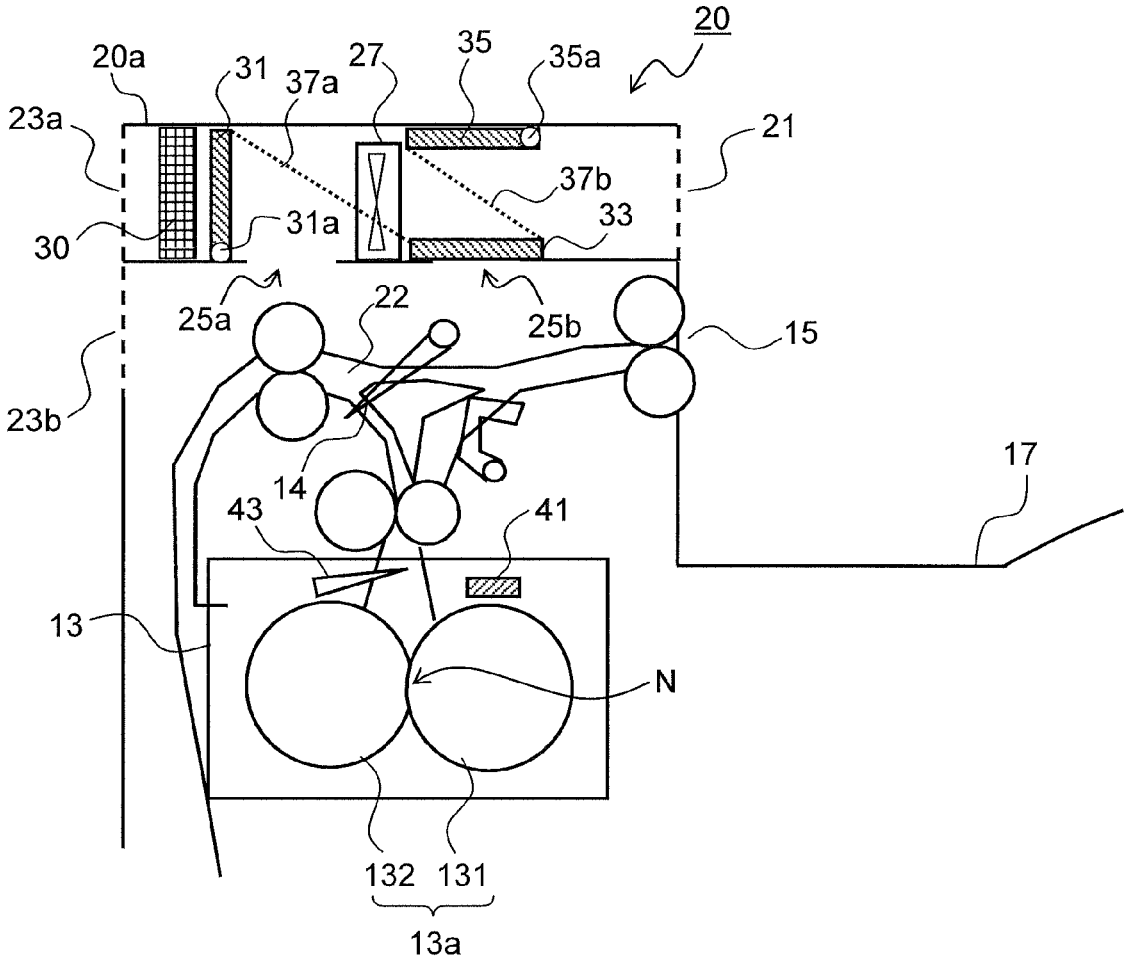
FIG. 3 is a sectional side view of and around the exhaust duct unit 20, showing how air inside the color printer 100 is expelled through a first outlet 23*a;*
Figure 4:
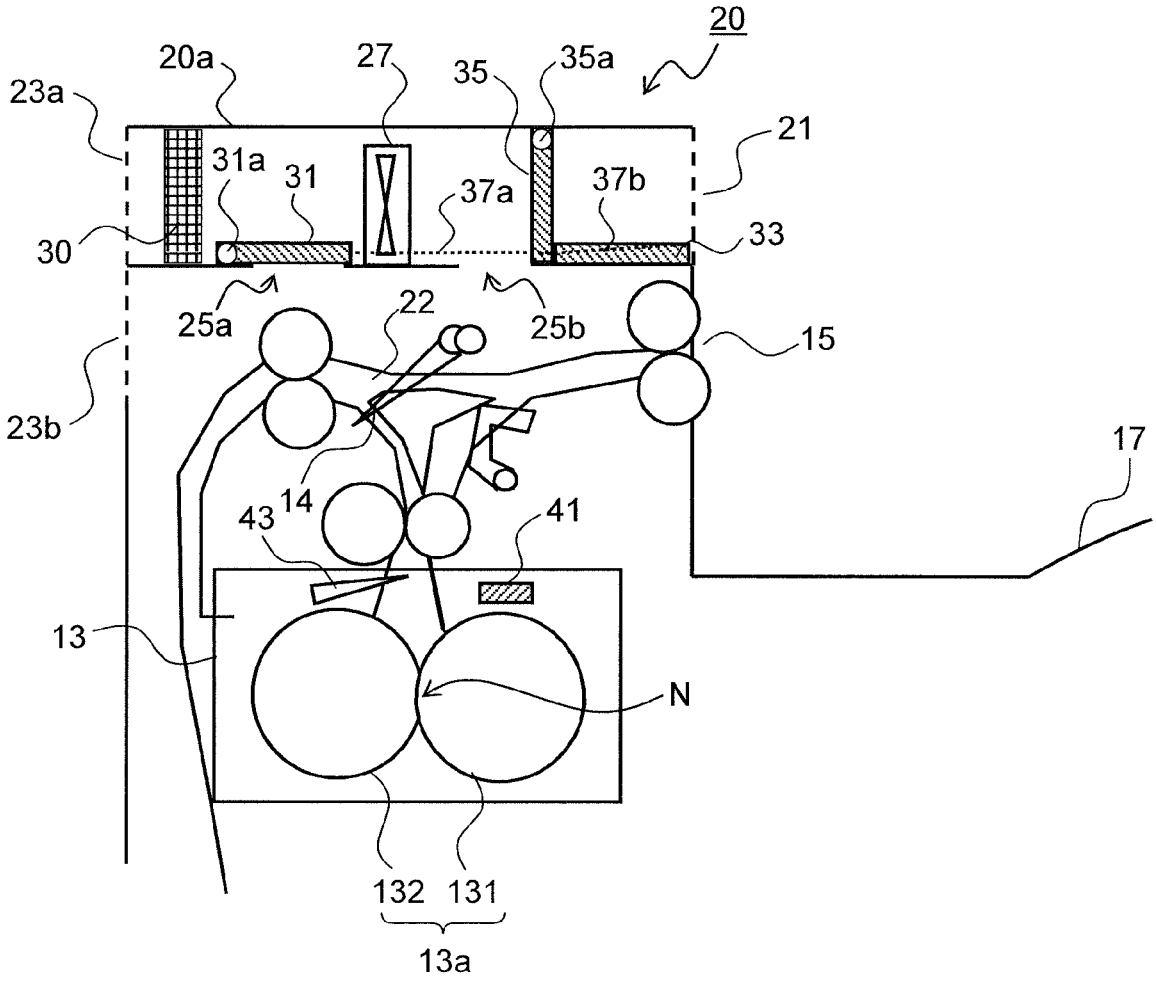
FIG. 4 is a sectional side view of and around the exhaust duct unit 20, showing how air inside the color printer 100 is expelled through a second outlet 23*b;*

FIG. 2 is a sectional plan view of and around the exhaust duct unit 20 in the color printer 100 shown in FIG. 1. FIGS. 3 and 4 are sectional side views of and around the exhaust duct unit 20. FIG. 3 shows how the air inside the color printer 100 is expelled through a second outlet 23*b*, and FIG. 4 shows how it is expelled through a first outlet 23*a*. Now, with reference to FIGS. 2 to 4, the structure of the exhaust duct unit 20 will be described in detail.

The exhaust duct unit 20 is detachably attached to the color printer 100, beside a sheet transport passage 22 above the fusing device 13. The exhaust duct unit 20 has an exhaust duct 20*a* which has an air inlet 21 formed at one end and has a first outlet 23*a* formed at the other end. Inside the exhaust duct 20*a*, there are arranged a fan 27, a filter 30, a first shutter 31, a second shutter 33, and a third shutter 35. In the bottom face of the exhaust duct 20*a*, there are formed a first opening 25*a* and a second opening 25*b* which each communicate with the inside of the body of the color printer 100. On the other hand, in the body of the color printer 100, a second outlet 23*b* is formed separately from the exhaust duct 20*a*.

The fan 27 is arranged in substantially a central part of the exhaust duct 20*a*, and produces, inside the exhaust duct 20*a*, a stream of air from the air inlet 21 to the first outlet 23*a*. The filter 30 is arranged near the first outlet 23*a*, and collects ultrafine particles (UFPs), toner, etc. which move along with the stream of air through the exhaust duct 20*a*.

The first, second, and third shutters 31, 33, and 35 each switch the flow path of the air stream through the exhaust duct 20*a*. The first shutter 31 swings about a pivot 31*a* to switch between a position where it closes the first outlet 23*a* and opens the first opening 25*a* (the position in FIG. 3) and a position where it opens the first outlet 23*a* and closes the first opening 25*a* (the position in FIG. 4). The first shutter 31 is biased, by a torsion coil spring (unillustrated) provided on the pivot 31*a*, toward a position where it stands upright inside the exhaust duct 20*a* (toward the position in FIG. 3).

The second shutter 33 slides across the bottom face of the exhaust duct 20*a* to switch between a position where it closes the second opening 25*b* (the position in FIG. 3) and a position where it opens the second opening 25*b* (the position in FIG. 4).

The third shutter 35 swings about a pivot 35*a* to switch between a position where it opens the air inlet 21 (the position in FIG. 3) and a position where it closes the air inlet 21 (the position in FIG. 4). The third shutter 35 is biased, by a torsion coil spring (unillustrated) provided on the pivot 35*a*, toward a position where it lies flat on the top face of the exhaust duct 20*a* (toward the position in FIG. 3).

The swinging end (the upper end in FIG. 3) of the first shutter 31 and one end (the left end in FIG. 3) of the second shutter 33 are coupled together by a shutter coordinating film 37*a* in the form of a ribbon (or a cord). The other end (the right end in FIG. 3) of the second shutter 33 and the swinging end (the left end in FIG. 3) of the third shutter 35 are coupled together by a shutter coordinating film 37*b* in the form of a ribbon (or a cord). There is further arranged a drive gear 40 which meshes with a rack 33*a* extending from one end of the second shutter 33.

With this structure, as the drive gear 40 is rotated in the forward and reverse directions with a driving force from a motor (unillustrated), the second shutter 33 reciprocates along the exhaust duct 20*a* between the position in FIG. 3 (a first position) and the position in FIG. 4 (a second position). As the second shutter 33 reciprocates, the first and second shutters 31 and 35, which are coupled to the second shutter 33 by the shutter coordinating films 37*a* and 37*b*, reciprocate together between the position in FIG. 3 (a first position) and the position in FIG. 4 (a second position).

The fusing device 13 arranged under the exhaust duct unit 20 is provided with a fusing roller pair 13*a* composed of a fusing roller 131 and a pressing roller 132, and at a position facing the fusing roller 131, a thermistor 41 is arranged for sensing the surface temperature (fusing temperature) of the fusing roller 131. On the downstream side of the fusing nip N with respect to the sheet transport direction (the direction from bottom up), a sheet detection sensor 43 is arranged for sensing a sheet P that has passed through the fusing nip N. The results of sensing by the thermistor 41 and the sheet detection sensor 43 are transmitted to the controller 90 (see FIG. 1).

Figure 5:
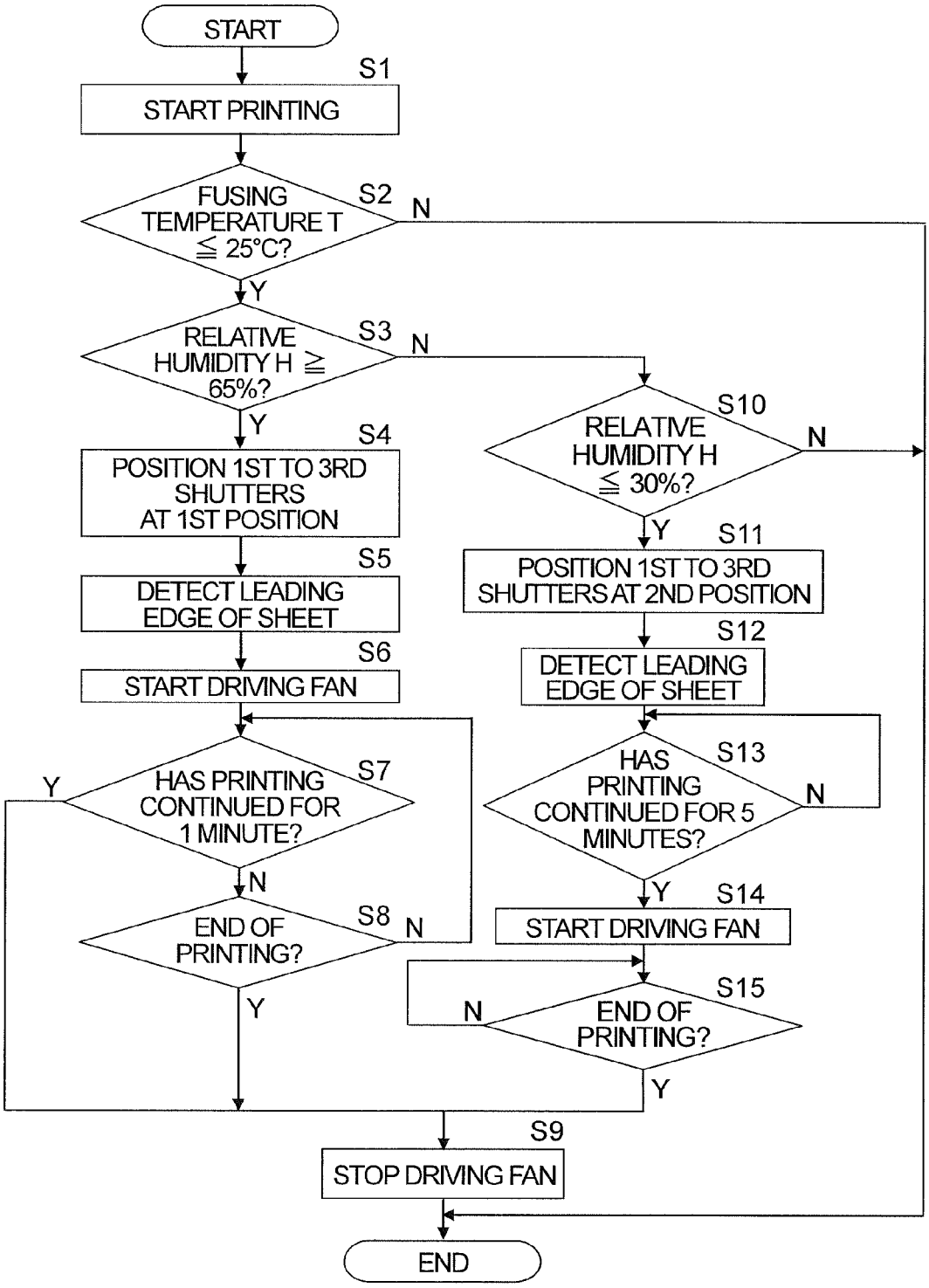
FIG. 5 is a flow chart showing an example of exhaust control by the exhaust duct unit 20.
Figure 6:
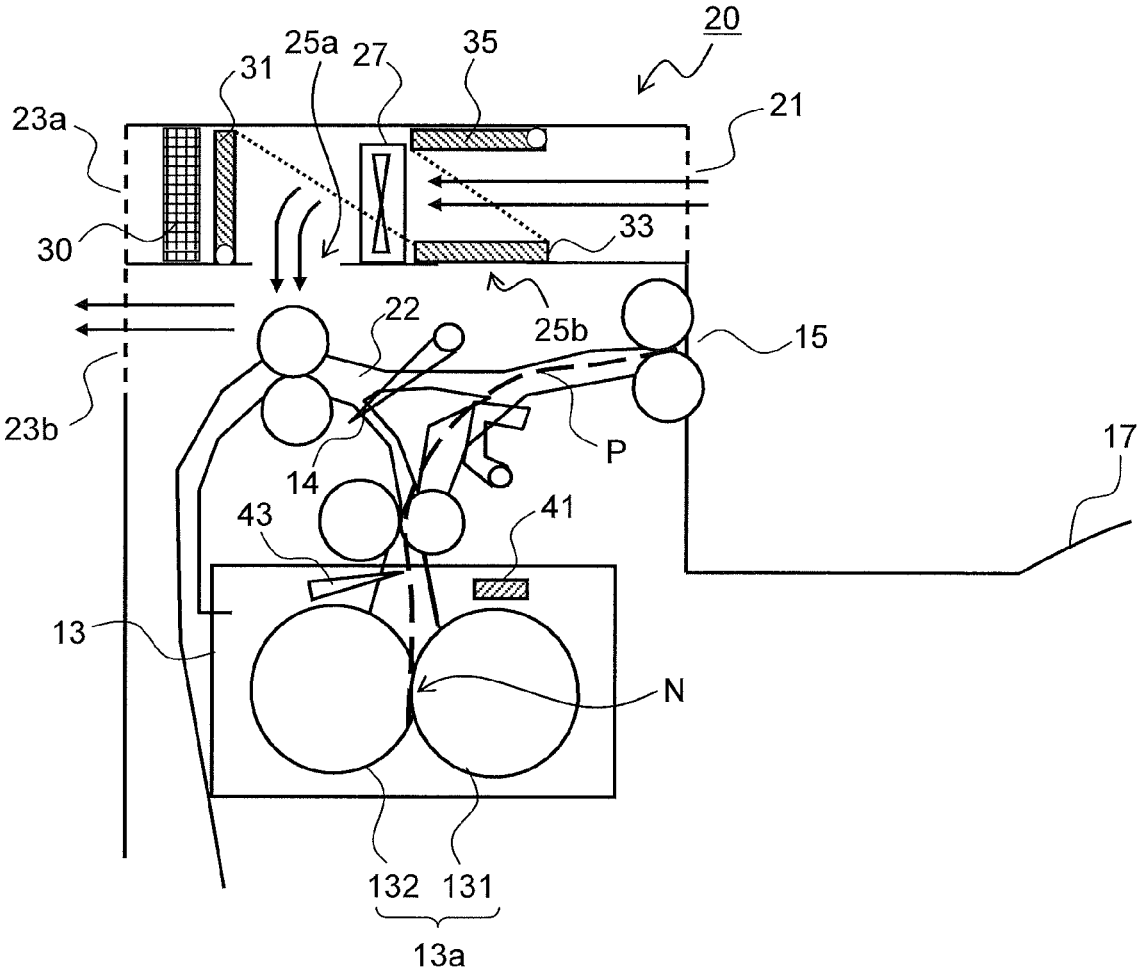
FIG. 6 is a side view showing how an air stream is expelled through the first outlet 23*a* by the exhaust duct unit 20 with the first to third shutters 31, 33, and 35 in a first position.
Figure 7:
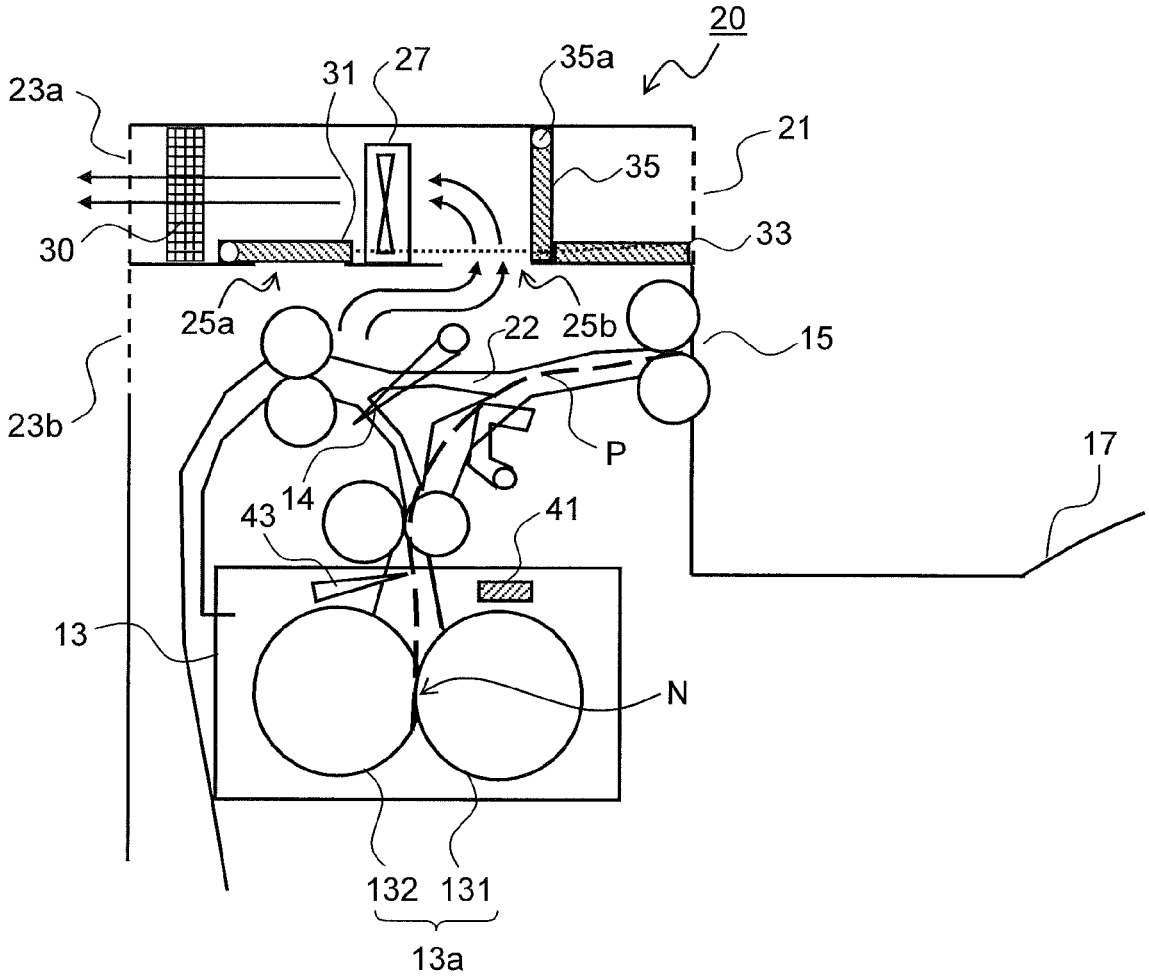
FIG. 7 is a side view showing how an air stream is expelled through the second outlet 23*b* by the exhaust duct unit 20 with the first to third shutters 31, 33, and 35 in a second position.

Next, the exhaust control by the exhaust duct unit 20 in the color printer 100 according to the present disclosure will be described in detail. FIG. 5 is a flow chart showing an example of how the operation of the exhaust duct unit 20 is controlled. FIG. 6 is a side view showing how a stream of air is exhausted via the first outlet 23*a* by the exhaust duct unit 20 with the first to third shutters 31, 33, and 35 in the first position, and FIG. 7 is a side view showing how a stream of air is exhausted via the second outlet 23*b* by the exhaust duct unit 20 with the first to third shutters 31, 33, and 35 in the second position. Now, along the flow of steps shown in FIG. 5, with reference also to FIGS. 1 to 4, 6, and 7 as necessary, an exhausting procedure carried out by the exhaust duct unit 20 will be described.

In response to an instruction to print from a personal computer or the like (Step S1), the controller 90 checks whether or not the fusing temperature T sensed by the thermistor 41 is equal to or less than a predetermined temperature T1 (e.g., 25° C.) (Step S2). If the fusing temperature T is equal to or less than the predetermined temperature T1, the controller 90 then checks whether or not the relative humidity H sensed by the exterior humidity sensor 50 equals to or more than a predetermined value H1 (e.g., 65%) (Step S3). If the relative humidity H is equal to or more than 65% (Step S3, Y (Yes)), the controller 90 transmits a control signal so as to rotate the drive gear 40 in a predetermined direction. As a result, as shown in FIGS. 3 and 6, the second shutter 33 is positioned in the first position, and the first and third shutters 31 and 35, which are coupled to the second shutter 33 by the shutter coordinating films 37*a* and 37*b*, also are positioned in the first position (Step S4).

Thereafter, when printing starts, in the image forming sections Pa to Pd, toner images start to be formed on the photosensitive drums 1*a* to 1*d*, and a sheet of paper P is fed from the sheet cassette 16 to the registration roller pair 12*b*. In coordination with the timing with which the toner images are primarily transferred from the photosensitive drums 1*a* to 1*d* to the intermediary transfer belt 8, the sheet P is transported from the registration roller pair 12*b* to the secondary transfer nip, where the full-color image on the intermediary transfer belt 8 is transferred to the sheet P. The sheet P having the toner image transferred to it is transported on to the fusing device 13.

When the sheet detection sensor 43 detects the leading edge of the sheet P (Step S5), the controller 90 transmits a control signal so as to start driving the fan 27 to rotate (Step S6). Then, as indicated by arrows in FIG. 6, a stream of air sucked into the exhaust duct 20*a* through the air inlet 21 by the fan 27 enters the body of the color printer 100 through the first opening 25*a*, passes around the sheet transport passage 22, and is expelled out of the color printer 100 through the second outlet 23*b* (a first exhaust path).

Thus, water vapor arising from the sheet P (indicated by a broken line in FIG. 6) heated by the fusing roller 131 is, along with the air stream passing around the sheet transport passage 22, expelled out of the color printer 100 through the second outlet 23*b*. Thus, no air containing water vapor passes through the filter 30, and this helps suppress degradation in the performance of collection of the ultrafine particles (UFPs) resulting from the filter 30 getting wet with moisture. Moreover, the air stream containing water vapor is diffused by the fan 27, and this prevents the water vapor from steaming from one spot, thereby preventing a user from erroneously recognizing it as smoking.

Next, the controller 90 checks whether or not printing has continued for one minute (Step S7). If the continuous printing duration is less than one minute (Step S7, N (No)), the controller 90 then checks whether or not printing has ended (Step S8), and if printing is still in process, the controller 90 returns to Step S7, where it continues monitoring the continuous printing duration. If printing has ended, the controller 90 stops driving the fan 27 (Step S9). If the continuous printing duration is one minute or more, even if printing is still in process, the controller 90 stops driving the fan 27 (Step S9).

On the other hand, if the relative humidity H sensed by the exterior humidity sensor 50 is less than 65% (Step S3, N), the controller 90 then checks whether or not the relative humidity H is equal to or less than a predetermined value H2 (e.g., 30%) (Step S10). If the relative humidity H is equal to or less than 30% (Step S10, Y), the controller 90 transmits a control signal so as to rotate the drive gear 40 in a predetermined direction. As a result, as shown in FIGS. 4 and 7, the second shutter 33 is positioned in the second position, and the first and third shutters 31 and 35, which are coupled to the second shutter 33 by the shutter coordinating films 37*a* and 37*b*, also are positioned in the second position (Step S11).

Thereafter, when printing starts and then the sheet detection sensor 43 detects the leading edge of a sheet P (Step S12), the controller 90 checks whether or not printing has continued for five minutes (Step S13). If the continuous printing duration is equal to or more than five minutes (Step S13, Y), the controller 90 transmits a control signal to start driving the fan 27 to rotate (Step S14). Then, as indicated by arrows in FIG. 7, now that the air inlet 21 is closed by the third shutter 35, the fan 27 sucks the air around the sheet transport passage 22 into the exhaust duct 20*a* through the second opening 25*b*, which is opened by the second shutter 33. The air stream sucked into the exhaust duct 20*a* passes through the filter 30, and is expelled out of the color printer 100 through the first outlet 23*a* (a second exhaust path).

When printing continues for five minutes or more and the fusing roller 131 is heated to over a predetermined temperature, ultrafine particles (UFPs) arise from the silicone rubber used as an elastic layer. With the configuration described above, the air stream containing ultrafine particles (UFPs) is expelled to the outside through the filter 30, and this helps suppress the spread of ultrafine particles (UFPs) into the environment.

Then, the controller 90 checks whether or not printing has ended (Step S15), and if printing is still in process, the controller 90 repeats printing while rotating the fan 27. If printing has ended, the controller 90 stops driving the fan 27 (Step S9).

Incidentally, if, when an instruction to print is entered, the fusing temperature T is more than the predetermined temperature T1 (Step S2, N), or if, even when the fusing temperature T is equal to or less than the predetermined temperature T1, the relative humidity H is more than 30% but less than 65% (Step S10, N), no exhausting by the fan 27 is performed (a normal mode).

As described above, according to the present disclosure, exhaust control whereby ultrafine particles (UFPs) arising from the fusing device 13 is collected with the filter 30 (a UFP collection mode) and exhaust control whereby water vapor arising from a sheet P during fusing is diffused and expelled to the outside without making the filter 30 wet (a water vapor diffusion mode) can be selectively performed according to fusing temperature, ambient humidity, and continuous printing duration.

On the other hand, when the fusing temperature T is more than a predetermined temperature T1, or when the relative humidity H is within a predetermined temperature (30%<H<65%), that is, under a condition where neither water vapor nor ultrafine particles (UFPs) are likely to arise, no exhausting by the fan 27 is performed. This helps minimize the driving of the fan 27, and is expected to lead to less noise and lower power consumption during image formation.

Although in the exemplary control shown in FIG. 5, the fan 27 is rotated and stopped according to continuous printing duration, the fan 27 may be rotated and stopped according to, instead of continuous printing duration, continuous number of prints. For example, in a case where the color printer 100 has a process speed of 20 sheets per minute, the water vapor diffusion mode can be stopped when 20 sheets have been printed continuously, and the UFP collection mode can be started when 100 sheets have been printed continuously.

It should be noted that the present disclosure is in no way limited by any embodiment specifically described herein and allows for many modifications and variations within the spirit of the present disclosure. For example, although in the embodiment described above, how the fusing roller 131 is heated is not discussed in detail, it is possible to adopt induction heating so that heat fusing roller 131 is heated with an induction heating unit, or to adopt a construction where the fusing roller 131 is provided with a halogen heater inside it; that is, it is possible to adopt any of fusing devices 13 that heat a fusing roller 131 in a variety of ways. The present disclosure finds application also in image forming apparatuses provided with a heated-belt fusing device where an endless fusing belt is heated and a toner image is fused to a recording medium at the nip between the fusing belt and a pressing roller.

The present disclosure finds application not only in tandem-type color printers 100 like the one shown in FIG. 1 but in various image forming apparatuses in general provided with a fusing device, such as a monochrome copiers, digital multifunction peripherals, facsimile machines, and laser printers.

The present disclosure finds application in image forming apparatuses provided with a fusing device, such as copiers, printers, facsimile machines, and multifunction peripherals functioning as more than one of the just-mentioned devices. According to the present disclosure, it is possible to provide an image forming apparatus that can diffuse, and expel to the outside, water vapor arising from a recording medium during fusing and that can also suppress the spread, to the outside, of ultrafine particles (UFPs) arising from a fusing device.

What is claimed is:

1. An image forming apparatus comprising:

a fusing device having a heated member which is heated by a heat source and a pressing member which is put in pressed contact with the heated member, wherein a recording medium carrying an unfused toner image is nipped at a fusing nip formed between the heated member and the pressing member so as to fuse and fix the unfused toner image to the recording medium;

an exhaust duct unit arranged over the fusing device, beside it, the exhaust duct unit expelling air around the fusing device out of the image forming apparatus, wherein an exhaust path through the exhaust duct unit is selectable between a first exhaust path through which outside air sucked into the image forming apparatus is passed through a space around the fusing device and is then expelled out of the image forming apparatus, and a second exhaust path in which a filter for collecting particles contained in an air stream is arranged and through which the air around the fusing device is passed through the filter and is then expelled out of the image forming apparatus;

a fusing temperature sensor for sensing a fusing temperature of the heated member;

an exterior humidity sensor for sensing a relative humidity outside the image forming apparatus; and a controller for controlling the exhaust duct unit based on results of detection by the exterior humidity sensor and the fusing temperature sensor, wherein when, at a time point that an instruction to print is entered, the fusing temperature T sensed by the fusing temperature sensor is equal to or less than a predetermined temperature T1 and in addition the relative humidity H sensed by the exterior humidity sensor is equal to or more than a predetermined value H1, the controller performs exhausting through the first exhaust path, and when, at a time point that an instruction to print is entered, the fusing temperature T sensed by the fusing temperature sensor is equal to or less than the predetermined temperature T1 and in addition the relative humidity H sensed by the exterior humidity sensor is equal to or less than a predetermined value H2, where H2<H1, the controller performs exhausting through the second exhaust path.

2. The image forming apparatus according to claim 1, wherein the controller continues exhausting through the first exhaust path until a continuous printing duration reaches a predetermined duration or until a continuous number of prints reaches a predetermined number.

3. The image forming apparatus according to claim 1, wherein the controller starts exhausting through the second exhaust path after a continuous printing duration has reached a predetermined duration or after a continuous number of prints has reached a predetermined number.

4. The image forming apparatus according to claim 1, wherein the exhaust duct unit is detachably attached to a body of the image forming apparatus.

5. An image forming apparatus comprising:

a fusing device having a heated member which is heated by a heat source and a pressing member which is put in pressed contact with the heated member, wherein a recording medium carrying an unfused toner image is nipped at a fusing nip formed between the heated member and the pressing member so as to fuse and fix the unfused toner image to the recording medium; and an exhaust duct unit arranged over the fusing device, beside it, the exhaust duct unit expelling air around the fusing device out of the image forming apparatus, wherein an exhaust path through the exhaust duct unit is selectable between a first exhaust path through which outside air sucked into the image forming apparatus is passed through a space around the fusing device and is then expelled out of the image forming apparatus, and a second exhaust path in which a filter for collecting particles contained in an air stream is arranged and through which the air around the fusing device is passed through the filter and is then expelled out of the image forming apparatus, the exhaust duct unit includes:

an exhaust duct arranged over the fusing device, beside it;

a fan arranged inside the exhaust duct;

an air inlet formed at one end of the exhaust duct;

a first outlet formed at another end of the exhaust duct, for expelling therethrough air having passed through the exhaust duct out of the image forming apparatus by way of the filter;

a first opening through which a downstream side of the fan communicates with the space around the fusing device with respect to an air stream passing through the exhaust duct;

a second opening through which an upstream side of the fan communicates with the space around the fusing device;

a first shutter swingable between a first position where the first shutter closes the first outlet and opens the first opening and a second position where the first shutter opens the first outlet and closes the first opening;

a second shutter swingable between a first position where the second shutter closes the second opening and a second position where the second shutter opens the second opening; and a third shutter swingable between a first position where the third shutter opens the air inlet and a second position where the third shutter closes the air inlet, a second outlet is formed in a body of the image forming apparatus, for expelling therethrough air that has passed through the space around the fusing device out of the image forming apparatus, and the controller switches between the first and second exhaust paths by swinging the first to third shutters between the first position and the second position.

6. The image forming apparatus according to claim 5, further comprising:

a shutter driving mechanism for driving the second shutter; and a shutter coordinating member for coupling the first and third shutters to the second shutter, wherein, as the shutter driving mechanism swings the second shutter between the first position and the second position, in coordination with the second shutter, the first and third shutters swing between the first position and the second position.

* * * * *